United States Patent [19]

Pouget et al.

[11] Patent Number: 4,899,682

[45] Date of Patent: Feb. 13, 1990

[54] CATAMARAN-TYPE SEMISUBMERSIBLE DRILLING VESSEL FOR OFFSHORE DRILLING

[75] Inventors: Gilles Pouget, Nozay; Jean Chevallier, Paris, both of France; Gene Hampton, Aberdeen, Scotland

[73] Assignee: Schlumberger Technology Corporation, Houston, Tex.

[21] Appl. No.: 123,020

[22] Filed: Nov. 19, 1987

[30] Foreign Application Priority Data

Dec. 3, 1986 [FR] France ..... 86 16942

[51] Int. Cl.[4] ..... B63B 35/44

[52] U.S. Cl. ..... 114/264; 114/265

[58] Field of Search ..... 114/125, 264, 265, 266; 405/209, 211, 217, 224; 414/22; 125/7, 8, 85; 166/350, 352, 359, 367

[56] References Cited

U.S. PATENT DOCUMENTS

| | | | |
|---|---|---|---|
| 2,690,847 | 10/1954 | Crookston . | |
| 3,513,996 | 5/1970 | Woolslayer et al. . | |
| 3,559,821 | 2/1971 | James . | |
| 3,774,780 | 11/1973 | Buffington . | |
| 3,987,910 | 10/1976 | Brunato . | |
| 4,044,895 | 8/1977 | Adair . | |
| 4,117,941 | 10/1978 | McCleskey et al. | 114/265 |
| 4,379,676 | 4/1983 | Frias . | |
| 4,435,108 | 3/1984 | Hampton | 405/209 |
| 4,646,672 | 3/1987 | Bennett et al. | 114/265 |

FOREIGN PATENT DOCUMENTS

| | | |
|---|---|---|
| 1151144 | 8/1983 | Canada . |
| 0174055 | 11/1986 | European Pat. Off. . |
| 2336903 | 6/1975 | Fed. Rep. of Germany . |
| 2735172 | 10/1979 | Fed. Rep. of Germany . |
| 8303115 | 4/1985 | Netherlands . |
| 8303671 | 5/1985 | Netherlands . |
| WO85/03050 | 7/1985 | PCT Int'l Appl. . |
| 1319270 | 6/1973 | United Kingdom . |
| 1493778 | 11/1977 | United Kingdom . |
| 1494964 | 12/1977 | United Kingdom . |

OTHER PUBLICATIONS

Mowell & Bakonyim, "New Semi Features Better Heave Response, Vertical Riser Storage," World Oil, Oct. 1986.

*Primary Examiner*—Sherman D. Basinger
*Assistant Examiner*—Stephen P. Avila
*Attorney, Agent, or Firm*—Stephen L. Borst

[57] ABSTRACT

The semisubmersible drilling vessel has two spaced, parallel, horizontal, elongated submersible hulls which support a deck and a deck mounting structure. The deck has a central opening overhanging the space between the two hulls and is surmounted by a derrick. The mounting structure includes at least two vertical columns which connect the ends of the hulls to the deck and at least two hollow columns facing and spaced from one another substantially in the center of each hull. These central hollow columns form caissons on the interior of which is provided pipe manipulation apparatus which accommodates the handling and vertical storage of pipes associated with drilling a well.

9 Claims, 4 Drawing Sheets

CATAMARAN-TYPE SEMISUBMERSIBLE DRILLING VESSEL FOR OFFSHORE DRILLING

Figure 1:
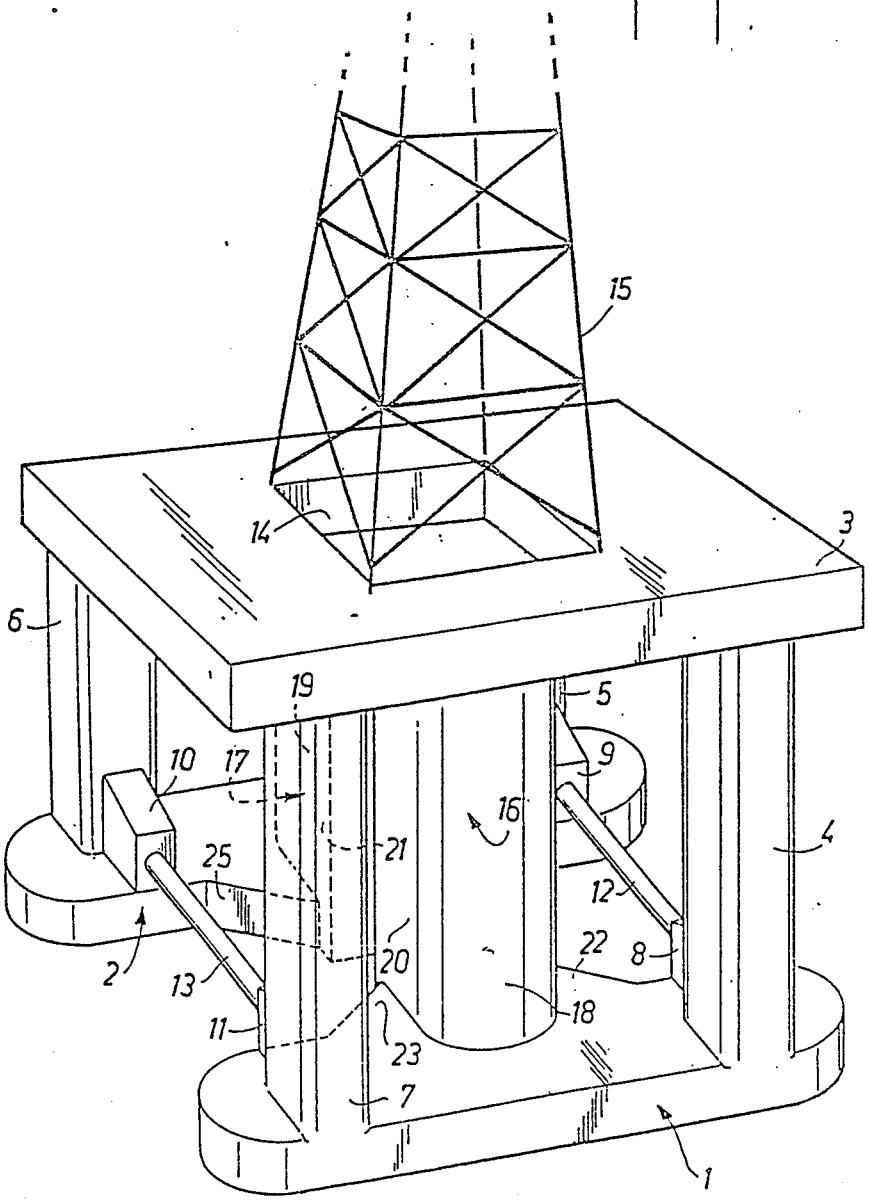

The invention relates to a senisubmersible drilling vessel for offshore drilling of the catamaran type, i.e. having two substantially horizontal, parallel and spaced, elongated submersible hulls, a deck supported above said hulls and connected thereto by a mounting structure, the deck having a central opening overhanging the space between the two hulls and being surmounted by a derrick. Said mounting structure has vertical columns, whereof at least two pairs connect the ends of the hulls to the deck.

Such a general structure is e.g. known from U.S. Pat No. 4,435,108. Moreover, various equipments are provided on such drilling vessels, particularly cranes and means for the storage and handling of pipes.

The term pipes is understood to mean two basic types of long cylindrical elements used in large quantities on such a drilling vessel and namely drill pipes having a length of e.g. about 10 meters and a diameter of about 12 centimeters and risers having a length of about 15 meters and a diameter of a little more than one meter.

Usually these pipes are stored horizontally. It is therefore necessary to provide a handling means, like that known from GB-A-No. 1319270, which is designed for lifting the pipes and for placing them in their vertical use position.

To obviate this needless change of position of the pipes, means have already been proposed for the vertical storage of individual drill pipes. Thus, in U.S. Pat. No. 4,044,895 or GB-A-No. 1494964, the drill pipes are stored in juxtaposed manner over the entire surface of a storage area located beneath the deck of the drilling vessel, so as to lower the centre of gravity thereof. Storage particularly suffers from the disadvantage of occupying a considerable floor or ground space and of only permitting a successive access to the different drill rods, unless a device is provided for the upward extraction thereof and which is able to move above the entire ground surface, which increases the overall dimensions.

An article in the journal "Ocean Industry", August 1985 reports on a catamaran-type drilling vessel project, in which the risers are stored vertically within a parallelepipedic median caisson connecting the two hulls of the catamaran. However, this median caisson suffers from serious disadvantages. On the one hand its presence between the hulls is prejudicial to the handling of the templates, cf. U.S. Pat. No. 4,435,108 and whose overall dimensions are about 10×40 m. Moreover, this median caisson produces a considerable draught of water and is highly exposed to a swell. There is nothing which outweighs the advantages of a catamaran more than adding a cross-wall thereto, which makes it possible to significantly increase the number of anchoring means.

According to another drilling vessel project of Friede & Goldman (New Orleans, La., USA) and called the "Trendsetter", below the derrick is provided an annular, central, cylindrical caisson, in whose peripheral thickness are vertically stored the risers. However, as in the case of the previous project, the presence of a central caisson is prejudicial to the handling of the templates. In addition, the volume of this central caisson must be severely limited otherwise it would offer an excessive surface area to the waves. Furthermore, the drill pipes are still horizontally stored. This caisson is also exposed to very high forces and stresses as a result of hydrostatic force, which involves a considerable bracing. However, braces are generally the weak point of drilling vessels due to the relative weakness of the welds. It is therefore best not to have an excessive increase in the number of braces. Finally, there is a risk of the water rising within the open volume of the caisson during ramming movements of the drilling vessel, which would have the effect of producing a prejudicial swabbing effect.

The problem of the present invention is to propose a novel catamaran-type semisubmersible drilling vessel not suffering from the aforementioned disadvantages and permitting the vertical storage of both the risers and the drill pipes without prejudicing the stability of the drilling vessel and without weakening its structure.

According to the invention this problem is solved in that the mounting or assembly structure connecting the hulls to the deck has at least two hollow columns forming caissons and internally provided with the pipe storage means arranged so as to permit vertical storage, said columns facing and being spaced from one another, being essentially located in the centre of each hull.

Advantageously storage is organised over the entire height of the columns so as to bring about a maximum increase in the storage capacity and reduce the centre of gravity of the drilling vessel. In addition, several pipe lengths are vertically stored.

Due to the fact that the columns of the mounting structure are used for storage purposes, there is no longer any need to provide a significant supplementary bracing. As the columns are spaced from one another, the central space gives the possibility of handling the templates and there is no cross-wall with respect to the catamaran direction.

The shape of the columns is chosen in such a way as to offer a large storage volume, but in particular a volume adapted to a linear organisation of the storage parallel to the vertical walls of the columns. To this end, the latter advantageously have a semi-cylindrical part turned towards the outside of the vessel and which is internally extended by two lateral flanges or cheeks, which makes it possible to easily provide a direct access system at each individual storage location by a lateral escape on either side of a linear circulation path along which the storage is organised. This direct access system advantageously has a travelling crane equipped with handling tongs. The extraction of the pipes from the storage column advantageously takes place by means of an elevator ramp.

Due to the fact that the pipes are essentially stored on two rows parallel to the semi-cylindrical walls and to the lateral cheeks of the hollow columns, in the centre of the latter there remains a volume available for the storage of other materials. Thus, there are several pulverulent material silo levels located as low as possible in the column for bringing about a maximum centre of gravity reduction. In this way it is possible to distribute a load of 1500 tonnes on the columns.

Above the location of these silos, each storage column has a pocket or cavity accessible by means of rails connecting the upper part of the columns and handling carriages or trolleys. These pockets serve to store blow out preventers.

These installations perfectly lend themselves to a complete automation of the handling of the different stored products or components.

Other advantages and features of the invention can be gathered from a preferred embodiment with reference to the attached drawings, wherein show:

FIG. 1 a diagrammatic longitudinal perspective view of an embodiment of the drilling vessel according to the invention.

Figure 2:
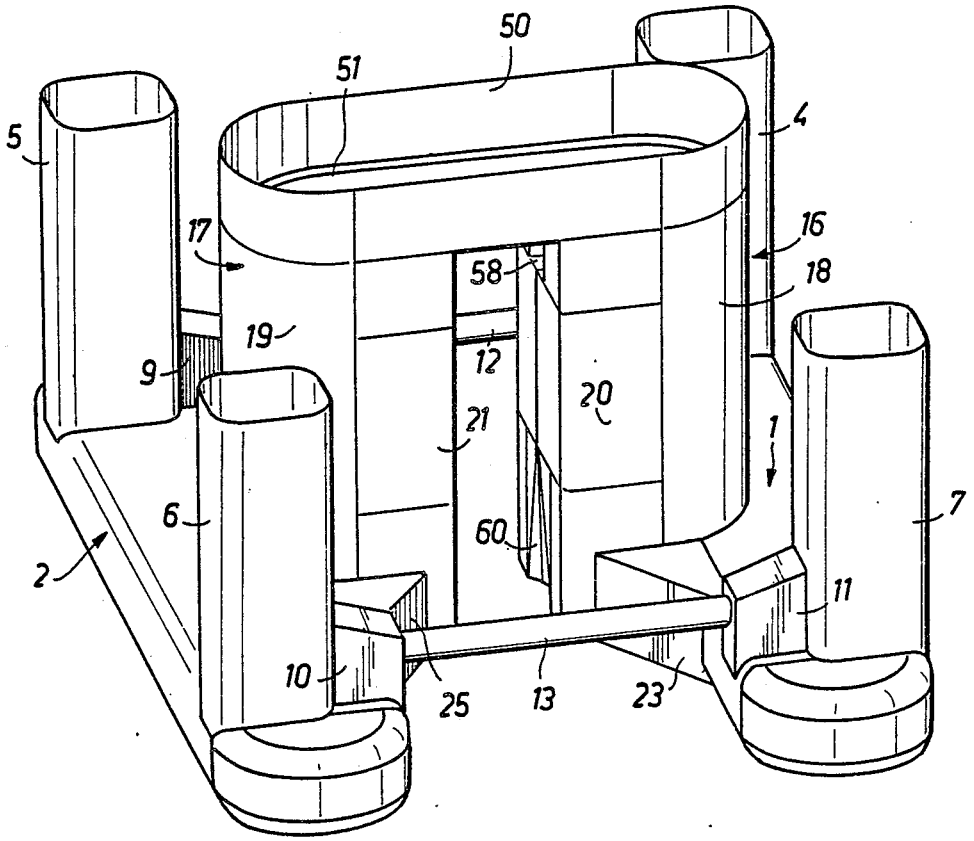

FIG. 2 a diagrammatic transverse perspective view of the vessel according to FIG. 1, the deck having been removed.

Figure 3:
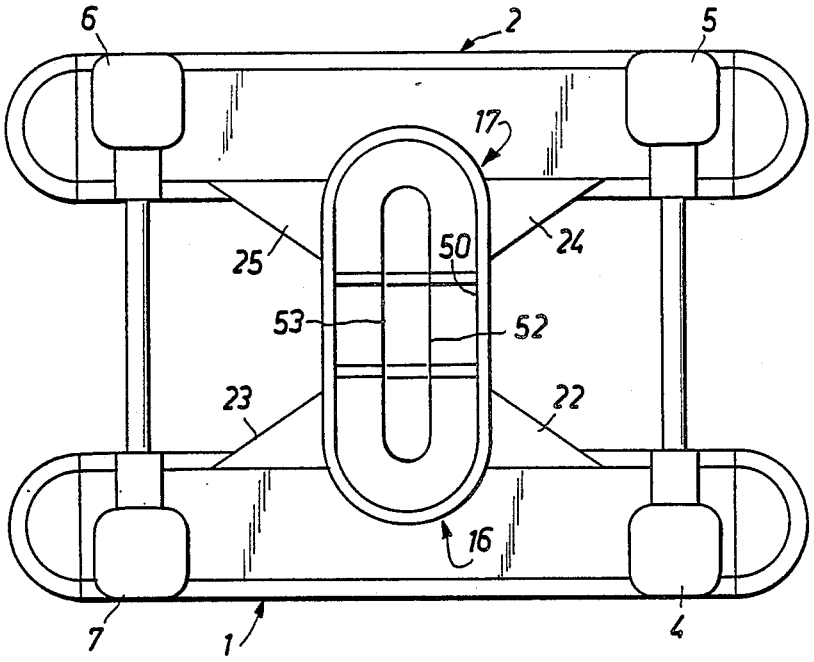

FIG. 3 a diagrammatic plan view of the vessel of FIG. 2.

Figure 4:
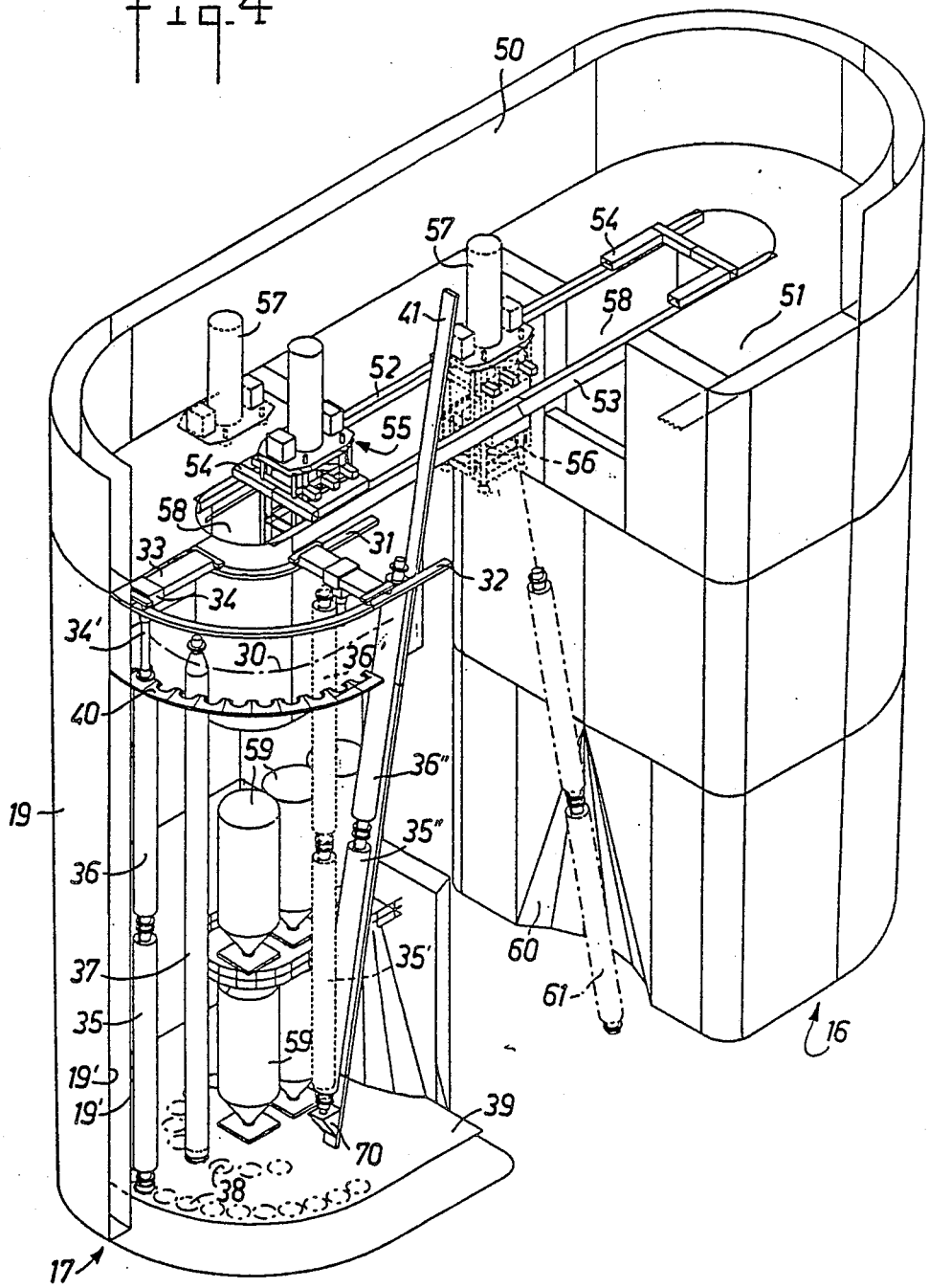

FIG. 4 a partly broken away perspective view of two supplementary columns within which the pipes are stored.

Figure 5:
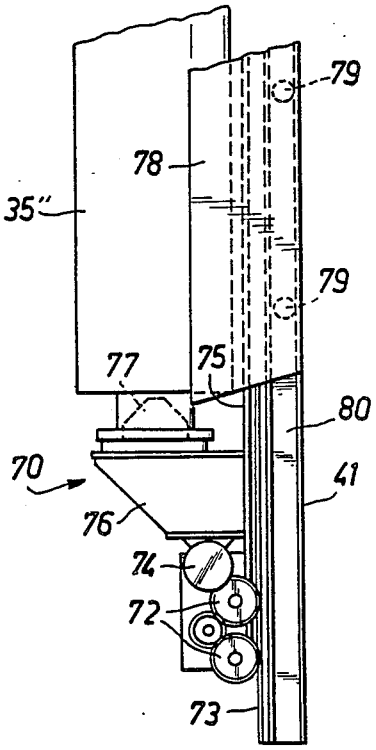

FIG. 5 a side view showing the detail of the lower part of the elevator ramp.

FIGS. 1 and 2 show a drilling vessel having two substantially parallel, horizontal submersible hulls 1 and 2. They have a length of approximately 90 m, a width of 17.5 m and a height of 8.5 m, leaving between them a distance of approximately 30 m. These hulls 1,2 support a rectangular deck 3 via a mounting or assembly structure having four columns 4,5,6,7 with a substantially square cross-section with a side length of 11 m and rounded angles. These columns are located towards the outside of hulls 1,2 and essentially at the end thereof in the vicinity of the rounded bows thereof, so as to ensure optimum stability of deck 3, whereof the lower surface is approximately 30 m above the hulls.

Buttresses 8,9,10,11 reinforce the foot of the columns on the face thereof turned towards the inside. Buttresses 8,9,10,11 are connected pairwise by braces 12,13 giving the necessary rigidity and strength to the mounting structure.

Deck 3, which is in fact formed by three superimposed deck stages, is centrally provided with an opening 14 surmounted by a derrick 15. The deck also has various installations and equipments which are not shown here, such as various cranes, storage areas, landing area, etc. There is also no need to describe the auxiliary means of the deck, such as the mooring system and the like, which are well known to the Expert and do not form part of the present invention.

According to the invention, the mounting structure also has two supplementary columns 16,17, which face one another in the centre of hulls 1,2. Columns 16,17 partly engage on hulls 1,2 and are extended towards one another and towards the centre of the deck, their facing faces leaving an intermediate space of about 20 m.

Each column 16,17 has a semi-cylindrical outer part 18,19, which essentially engages on hulls 1,2 and a parallelepipedic inner part 20,21 extending outside hulls 1,2 and descending to the lower level of the latter. Horizontal junction or stay plates 22,23,24,25 with the thickness of the hulls 1,2 connect, for reinforcenent purposes, the lateral cheeks or flanges of the inner part 20,21 of column 16,17 to the inside of hull 1,2.

The hulls and columns are constructed by assembling metal plates forming a double hull in accordance with the known naval construction methods. FIGS. 2 and 4 indicate in a purely informative manner the limits of certain assembly plates. FIG. 4 shows the double hull, e.g. 19' and 19" of the semi-cylindrical part 19 of column 17. Columns 16,17 vertically store pipes of all types, i.e. both drill pipes and risers. Storage takes place on either side of a linear circulation path 30 parallel to the semicylindrical wall and to the lateral cheeks of columns 16,17.

Two parallel rails 31,32 are mounted by adequate support means in the upper part of each column with a clearance enabling them to cover, on either side of the circulation path, the storage space. One or more automotive travelling cranes 33 run on rails 31,32 and have a handling device 34 able to move transversely with respect to path 30 along crane 33, so as to be positionable above any point of the storage space. Crane 33 can be remotely controlled by means well known to the Expert. Handling device 30 is provided in its lower part with a gripping member 34' (e.g. tongs) which can move vertically.

Bearing in mind the dimensions of risers (50 feet, i.e. 15.24 m) and drill pipes (30 feet, i.e. 9.14 m) and the available height in the columns (approximately 40 m), it has appeared advantageous to group the risers by the pairwise joining thereof, cf. 35,36 and to group the drill pipes in strings of three pipes placed end to end. As the diameter of the latter (5 inches, i.e. 12.7 cm) is well below that of the risers (46 inches, i.e. 116.84 cm), the strings of pipes are grouped in drums of twelve within a cylindrical container 37, whose diameter is close to that of the risers. Drum systems are known from the aforementioned article in Ocean Industry.

Risers 35,36 and containers 37 are stored on either side of the circulation path 30 at locations defined by elements 38 (pockets or protuberances) of a floor 39 of the columns and by indentations in two parallel racks 40 (only one being shown) with a lateral escape and which are equipped with a locking system.

Advantageously elements 38 are constituted by upwardly projecting inverted elastic cones onto which are fitted the lower end of risers 35,36 or containers 37 (whereof the lower end is also in hollow tubular form). The locking system is provided through the co-operation of the indentations of rack 40, in the form of open rings, and the upper part of risers 35,36 or containers 37 shaped so as to have an increasing diameter area from bottom to top. The diameter of the most narrowest part of said area is sufficiently small to permit the passage of said part into the opening (less than 180°) of the open ring, whilst the diameter of the widest part of said area does not permit said passage. Thus, after retracting risers 35,36 or a container 37 into one of the open rings of rack 40 by the narrow part thereof, it is sufficient to lower device 34' in order to lock said risers or said container.

Within each column, risers 35,36 and containers 37 are installed or removed by means of carriages or trolleys 33. As a result of the linear circulation path and the linear installation on either side thereof of approximately 20 individual storage locations, access to any one of these locations is free and subject to no priority.

The placing of risers 35,36 and containers 37 in each column 16,17, or the extraction thereof, takes place either by means of the lifting device of derrick 15, or by means of an independent lifting device, such as that constituted by an inclined elevator ramp 41 starting from the floor 39 of the column and leading to above the level of opening 14 of deck 3.

The general principle of such elevator ramps is well known to the Expert and reference can e.g. be made to U.S. Pat. No. 4,379,676. Such a ramp has at least one elevator trolley 70 able to run or be guided on ramp 41, being displaced by an endless chain system or preferably a system having pinions 72 and racks 73. For example (cf. FIG. 5), two parallel racks 73 are mounted on ramp 41 and are subject to the action of pinions 72 of trolley 70 driven by a motor 74 provided on the latter.

Trolley 70 has a longitudinal frame 75, at the bottom of which is formed a bracket 76, which carries an inverted elastic cone 77 (identical to elements 38), so as to be able to receive the bottom end of a riser 35" (or a container 37). Frame 75 has two lateral cheeks 78, between which are mounted wheels 79 guided in the lateral roller tracks 80 of ramp 41. The upper part of the frame is terminated by a second bracket carrying an open ring identical to those of rack 40.

The risers or containers are extracted from the hollow columns in the following way. Travelling crane 33 seeks the risers 35,36 or a container 37 in their storage location, brings them vertically along path 30 towards ramp 41 (reference 35', 36' in FIG. 4) until the foot of the risers is above the inverted cone 77 of trolley 70 of ramp 41. A subsequent translation of crane 33 towards ramp 41 stretches out the risers on said ramp (reference 35",36" in FIG. 4) and retracts the upper part thereof into the upper open ring of the frame of elevator trolley 70. A slight lowering of device 34 makes it possible to correctly fit the bottom of riser 35" onto cone 77 and to lock the top of riser 36" in the open ring provided for this purpose. After the disengagement of travelling crane 33, trolley 70 rises on ramp 41. On leaving deck 3, the risers can then be taken up by the lifting device of the derrick, or by any independent device.

Due to the fact that the two columns 16,17 are used for the storage of risers 35,36 and containers 37, the extraction thereof can be very fast and can overlap. A reverse process makes it possible to install the risers and containers.

The top of the columns 16,17 is covered above rails 31,32 by a surface 51 serving as a storage bridge laterally closed by a shell 50. The necessary rigidity and strength is ensured by a bracing system using not shown beams connecting the top of columns 16,17 and 4 to 7.

The elongated, annular storage bridge 51 surrounds two parallel rails 52,53 connecting the two columns 16,17 and supporting two motorized rolling trolleys 54 used for the movement of blow out preventers 55 for storage purposes.

The heavy lower part 56 of said preventers is advantageously stored, still supported by trolley 54, in pockets 58 provided in the upper part of each column 16,17 below rails 52,53 in the area not used for storing pipes. Each pocket 58 has means for locking the preventer in the stored position. The upper part 57 of said preventers (where the bottom part of the risers is located) is advantageously laterally stored on bridge 51.

In order to use a stored blow out preventer 55, it is merely necessary to bring it with the aid of its trolley 54 into the axis of the derrick, to take it up by using the lifting device of said derrick, to allow the escape of the trolley 54 shaped for this purpose and then to install it in the conventional way. The storage of a preventer takes place in the reverse order.

Within each column, beneath the preventer storage pockets 58, the available space is devoted to storage on two levels of powder material silos 59 (barite, cement, etc.).

The facing faces of columns 16,17 have at their base a conical or prismatic recess 60 for increasing the lateral displacement of the pipes 61 suspended on the lifting device of the derrick. In its maximum lateral displacement position, the axis of said pipes 61 can form an angle of at least 12° with the central vertical axis of the derrick.

The semisubmersible drilling vessel according to the invention is intended to be sunk into the water with an average height of approximately 24 m.

We claim:

1. A semisubmersible drilling vessel of the type comprising:

a pair of substantially parallel, substantially horizontal, elongated submersible hulls separated by a space therebetween;

a deck supported above said hulls and connected thereto by a mounting structure, said deck including an opening surmounted by a derrick overhanging said space;

means for handling pipes; and said mounting structure including a pair of hollow, structural, load bearing columns, at least one, internally provided with vertical pipe storage means, each of said columns having walls and being connected to and positioned along one of said hulls to be spaced from and to be facing one another across said space under said opening.

2. A vessel according to claim 1, wherein the pipe storage means are linearly organised parallel to the walls of said hollow columns.

3. A vessel according to claim 1, wherein the walls of said hollow columns essentially have a semi-cylindrical part turned towards the outside of the vessel and lateral cheeks.

4. A vessel according to claim 1, wherein the storage means have a direct access system with a lateral escape.

5. A vessel according to claim 1, wherein the stored pipes are grouped vertically in several lengths in order to occupy essentially the entire height of the hollow columns.

6. A vessel according to claim 1, wherein the storage means have at least one travelling crane.

7. A vessel according to claim 1, wherein the storage means have at least one elevator ramp.

8. A vessel according to claim 1, wherein the hollow columns are arranged so as to store pulverulent material silos.

9. A vessel according to claim 1, wherein the hollow columns have pockets for the storage of blow out preventers.

* * * * *

UNITED STATES PATENT AND TRADEMARK OFFICE

CERTIFICATE OF CORRECTION

PATENT NO. : 4,899,682

DATED : FEBRUARY 13, 1990

INVENTOR(S) : GILLES POUGET ET AL.

It is certified that error appears in the above-identified patent and that said Letters Patent is hereby corrected as shown below:

In column 6, line 29, please delete "," third occurence and substitute therefor --column--.

Signed and Sealed this

Twenty-fifth Day of June, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,899,682

DATED : February 13, 1990

INVENTOR(S) : Gilles Pouget et al.

It is certified that error appears in the above-identified patent and that said Letters Patent is hereby corrected as shown below:

On the title page, item [75], add the following inventors:
--Thanh Dang Tran-- and
--Jitendra Prasad--.

Signed and Sealed this

Third Day of September, 1991

*Attest:*

HARRY F. MANBECK, JR.

*Attesting Officer*

*Commissioner of Patents and Trademarks*